US007111732B1

(12) United States Patent
Houtler et al.

(10) Patent No.: US 7,111,732 B1
(45) Date of Patent: Sep. 26, 2006

(54) CHRISTMAS TREE DECORATION ORGANIZER

(76) Inventors: Jennifer Houtler, 7612 E. Downing St., Mesa, AZ (US) 85207; Douglas P. Gibbs, 555 W. Onstott Rd., Ste B., Yuba City, CA (US) 95991

( * ) Notice: Subject to any disclaimer, the term of this patent is extended or adjusted under 35 U.S.C. 154(b) by 409 days.

(21) Appl. No.: 10/737,308

(22) Filed: Dec. 16, 2003

(51) Int. Cl.
*B65D 85/62* (2006.01)

(52) U.S. Cl. ..... 206/499; 206/561; 206/565; 206/576

(58) Field of Classification Search ..... 206/6.1, 206/423, 418–420, 575, 576, 499, 557, 561, 206/565, 566, 583, 806
See application file for complete search history.

(56) References Cited

U.S. PATENT DOCUMENTS 2,950,003 A * 8/1960 Simmons et al. ..... 206/565
4,030,603 A * 6/1977 Angell ..... 206/499
4,729,474 A * 3/1988 Lanius et al. ..... 206/315.1
5,035,319 A * 7/1991 Kunisch ..... 206/6.1
5,816,407 A 10/1998 Daratony
6,334,536 B1 1/2002 Kanning
6,467,623 B1 * 10/2002 Lewis et al. ..... 206/575

* cited by examiner

*Primary Examiner*—Luan K. Bui
(74) *Attorney, Agent, or Firm*—Parsons & Goltry; Robert A. Parsons; Michael W. Goltry

(57) ABSTRACT

A Christmas tree decoration organizer including a box having a bottom and upwardly extending opposing sides and end walls, terminating in a rim. A plurality of ornament hangers having opposing ends are removably coupled within the box, suspended above the bottom for receiving and supporting a plurality of hanging ornaments. A bulk storage space for storing outermost decorations of a Christmas tree is defined by the bottom, lower portions of the opposing sides and the end walls, and the plurality of ornament hangers. An ornament tray is positioned within the box and supported above the plurality of ornament hangers for receiving and holding a plurality of Christmas tree ornaments. A separator panel is removably positioned covering the ornament tray and defining a light compartment thereabove. A cover is removable placed over the rim, closing the box.

18 Claims, 5 Drawing Sheets

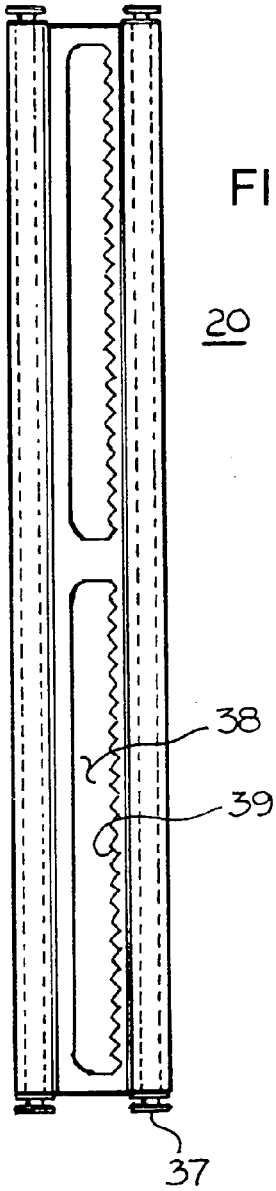
FIGURE 6
FIGURE 7
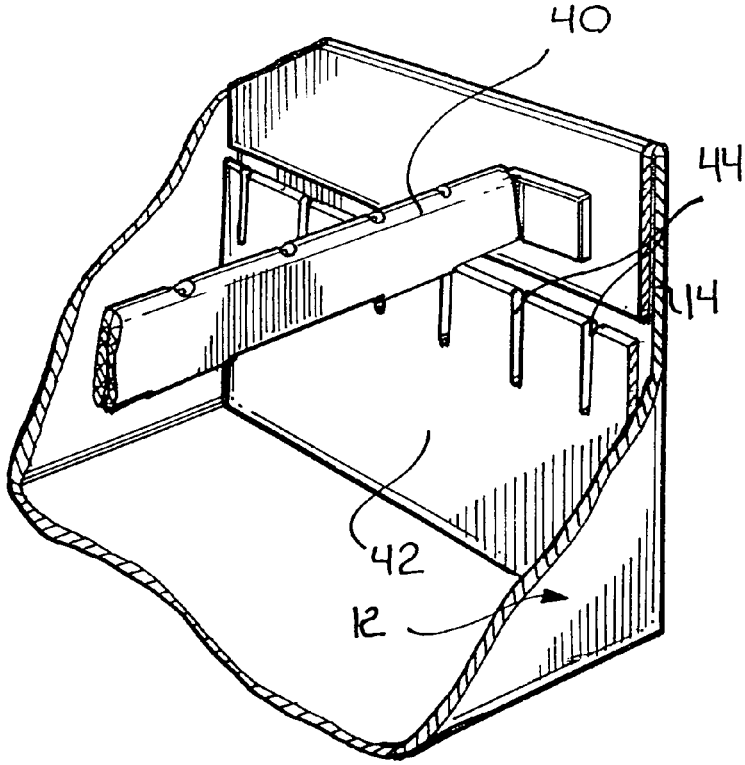

CHRISTMAS TREE DECORATION ORGANIZER

FIELD OF THE INVENTION

The present invention relates generally to Christmas decoration holders.

More specifically, the present invention relates to a Christmas organizer for the organization of Christmas items in a sequential order for decorating a Christmas tree.

BACKGROUND OF THE INVENTION

It can be appreciated that Christmas decoration holders and containers have been in use for years. Typically, Christmas decoration holders are comprised of ornament storage boxes, ornament chests, ornament boxes with drawers, and light boxes for storage of Christmas lights only. The main problem with conventional Christmas decoration holders are they do not provide storage of Christmas items in a logical manner for use when decorating a tree. Another problem with conventional Christmas decoration holders is they do not provide sturdy hardware which is removable to store Christmas items in a compact arrangement. Conventional Christmas decoration holders do not provide storage for the entire collection of ornaments and other Christmas items placed or used on a single Christmas tree.

While conventional storage containers may be suitable for the particular purpose to which they have been developed, they are not as suitable for the organization of Christmas items in a sequential order for decorating a tree. Also, another problem is they do not provide storage for a large variety of all Christmas items placed or used on a Christmas tree. In these respects, the Christmas organizer according to the present invention substantially departs from the conventional concepts and designs of the prior art, and in so doing provides an apparatus primarily developed for the purpose of the organization of Christmas items in a sequential order for decorating a tree.

It would be highly advantageous, therefore, to remedy the foregoing and other deficiencies inherent in the prior art.

Accordingly, it is an object of the present invention to provide a Christmas organizer that will overcome the shortcomings of the prior art devices.

Another object of the present invention is to provide a Christmas organizer for the organization of Christmas items in a sequential order for decorating.

And another object is to provide a Christmas organizer that organizes items in sequential/logical order, to decorate a Christmas tree.

Still another object is to provide a Christmas organizer that uses generally rigid nonpermanent hardware to hang ornaments.

Yet another object is to provide a Christmas organizer that stores the entire collection of decorations for a single Christmas tree.

SUMMARY OF THE INVENTION

Briefly, to achieve the desired objects of the instant invention in accordance with a preferred embodiment thereof, provided is a Christmas tree decoration organizer including a box having a bottom and upwardly extending opposing sides and end walls, terminating in a rim. A plurality of ornament hangers having opposing ends are removably coupled within the box. The plurality of ornament hangers extend between the opposing sides in a spaced apart parallel relationship, and are suspended above the bottom for receiving and supporting a plurality of hanging ornaments. A bulk storage space for storing outermost decorations of a Christmas tree is defined by the bottom, lower portions of the opposing sides and the end walls, and the plurality of ornament hangers. An ornament tray including dividers separating the ornament tray into a plurality of compartments is removably positioned within the box and supported above the plurality of ornament hangers for receiving and holding a plurality of Christmas tree ornaments. A separator panel is removably positioned covering the ornament tray. A light compartment is bounded by upper portions of the opposing sides and end walls, and the rim of the box for holding bundles of Christmas tree lights. A cover is removable engaged with the rim, closing the box.

In a specific aspect of the present invention, the coupling members each include an anchor portion positioned at an outer surface of the opposing sides of the box, and a keeper clip positioned on an inner surface of opposing sides of the box. The keeper clip is attached to the anchor portion, with each keeper clip removably receiving an end of one of the plurality of ornament hangers.

In another aspect of the present invention, the coupling members include inner side braces positioned within the box, each overlying an inner surface of the opposing sides and extending past the top of the bulk storage space to the bottom of a desired position of the ornament tray. An upper edge of each side brace includes slots formed therein to receive the ends of the ornament hangers.

Also provided is a method of storing decoration for a Christmas tree in a sequential manner for ease in subsequent decoration of a Christmas tree.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 6 is a plan view of an ornament hanger; and

FIG. 7 is a partial perspective view of another embodiment of the Christmas tree decoration organizer according to the present invention.

DESCRIPTION OF THE PREFERRED EMBODIMENT

Figure 1:
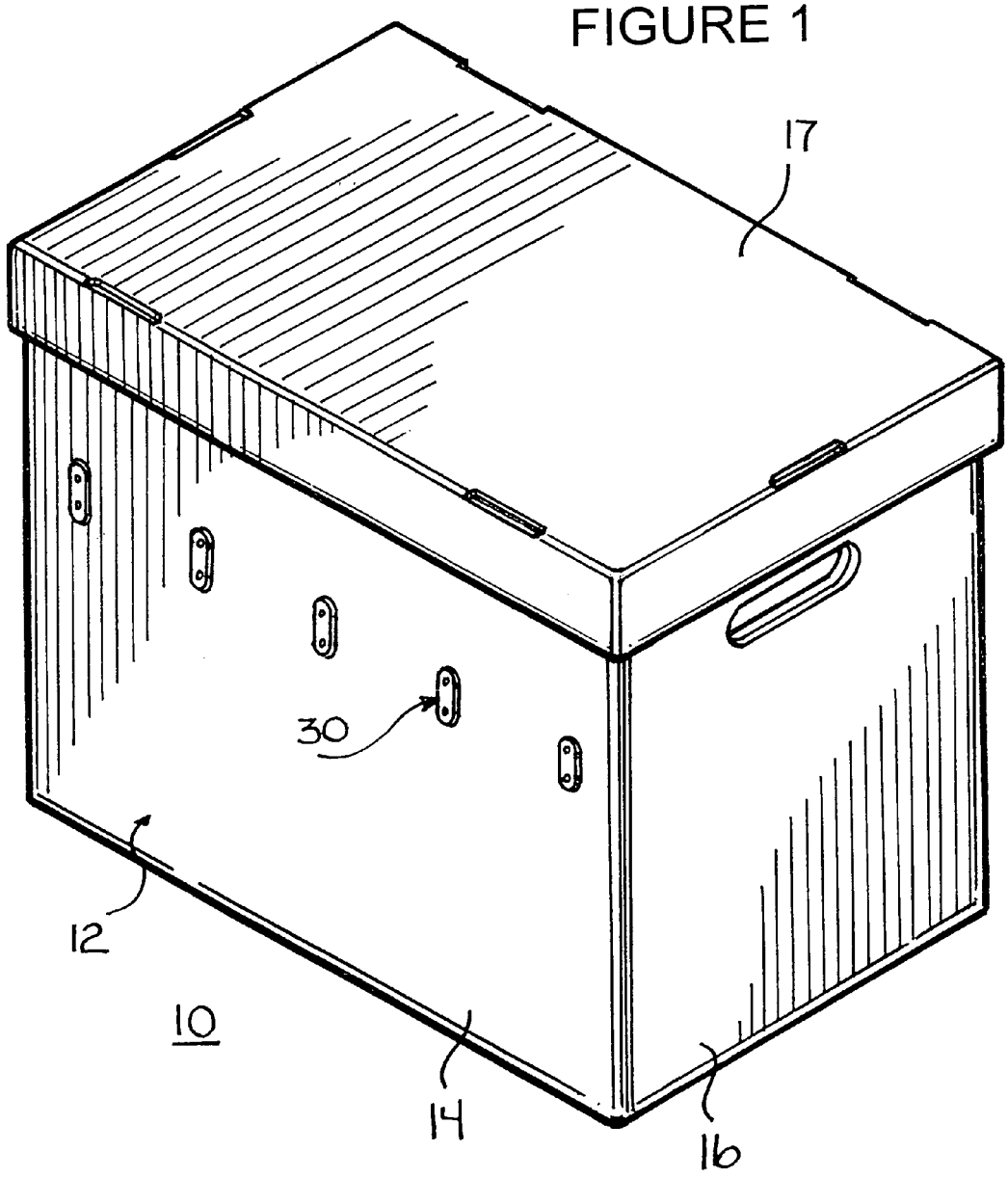
FIG. 1 is a perspective view illustrating a Christmas tree decoration organizer according to the present invention.

Turning now to the drawings, in which like reference characters indicate corresponding elements throughout the several views, attention is first directed to FIG. 1 which illustrates a Christmas tree decoration organizer generally designated 10. Organizer 10 is intended to store the entire collection of decorations, such as lights, ornaments, garlands and base wrap, for a single tree in a compact and easily stored configuration. The organization of the decorations within organizer 10 is in a sequence which starts with the lights, progresses through the ornaments to the garlands and finally the base wrapping over the tree stand. Thus an individual begins at the top of organizer 10 and, as the tree is decorated, works toward the bottom, removing various elements of the organizer to access underlying decorations.

Figure 2:
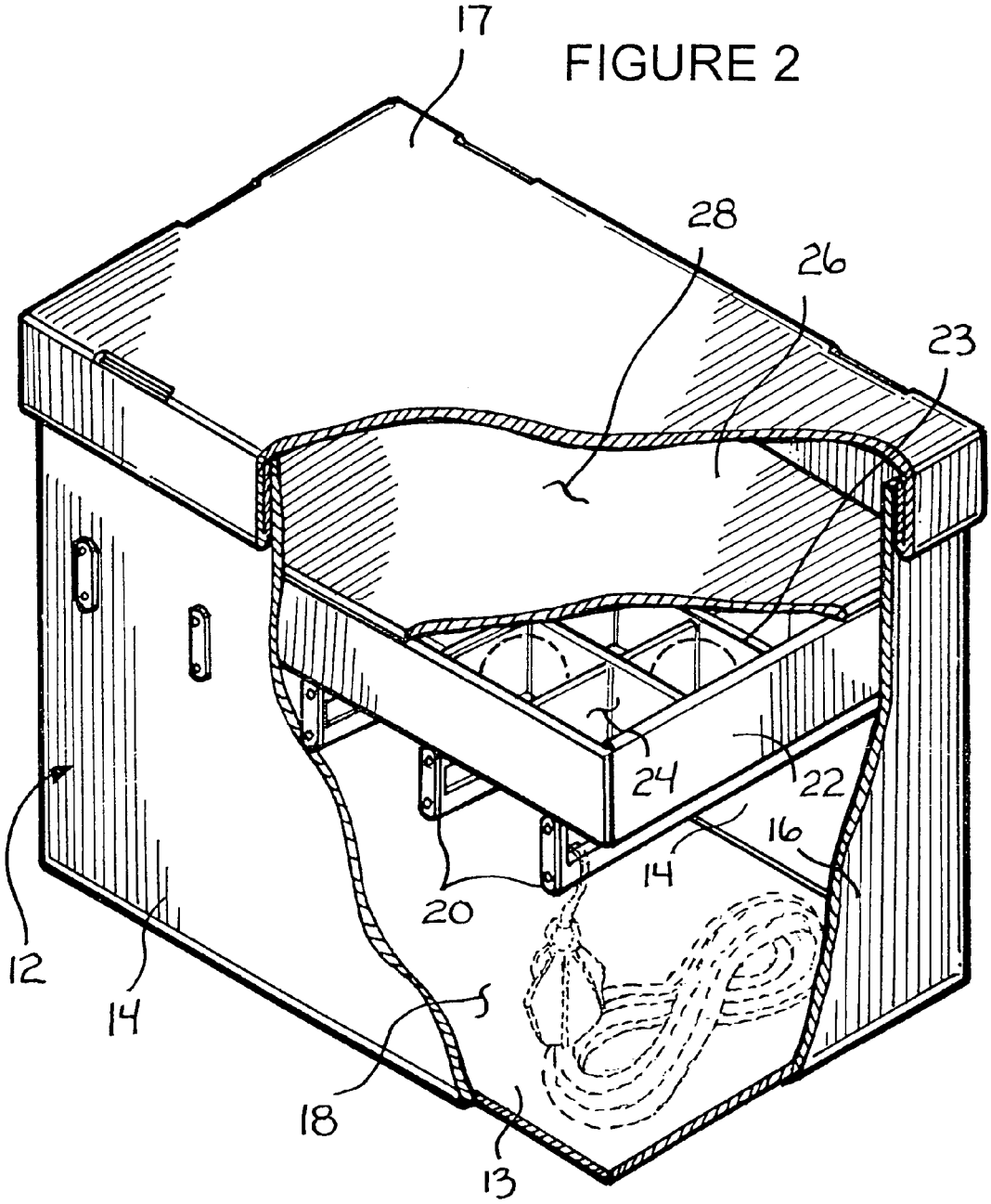
FIG. 2 is a perspective view of the Christmas tree decoration organizer of FIG. 1, with portion thereof removed.
Figure 3:
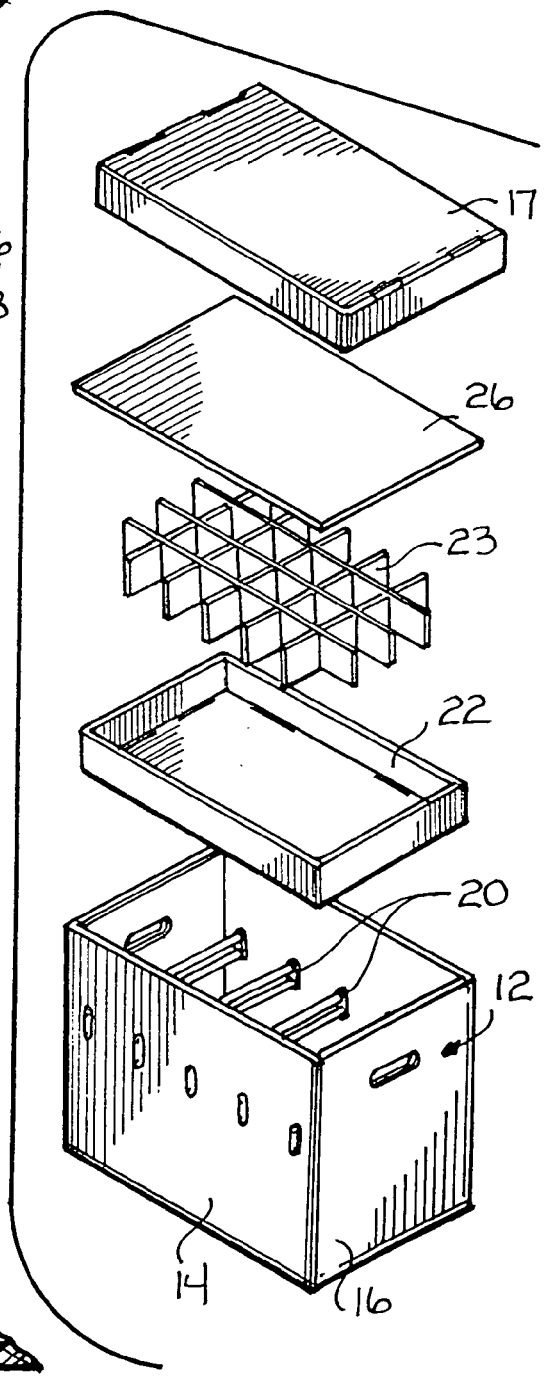
FIG. 3 is an exploded perspective view of the Christmas tree decoration organizer of FIG. 1.

With additional reference to FIGS. 2 and 3, organizer 10 includes a box 12 having a bottom 13, opposing sides 14 and end walls 16. Sides 14 and end walls 16 terminate in an upper rim 15. A cover 17 removably fits over rim 15, closing box 12. From bottom 13 of box 12 up, organizer 10 further includes a bulk storage space 18 defined by bottom 13, lower portions of sides 14 and end walls 16 and a plurality of ornament hangers 20. Ornament hangers 20 are elongated members that extend from opposing sides 14 of box 12 in a generally spaced apart and parallel relationship. Coupling of hangers 20 to box 12 will be described in detail, but include a coupling which permits easy removal and installation in box 12. Ornament hangers 20, in turn, support an ornament tray 22 thereon. Dividers 23 are positioned in tray 22 creating a plurality of compartments 24. One skilled in the art will realize that tray 22 and dividers 23 can be fabricated as a unitary piece, such as by vacuum molding plastic, or fabricated in multiple pieces using plastic, corrugated paper, wood or the like. A separator panel 26 is placed over tray 22, covering all of compartments 24. Panel 26 is a planar sheet of material which, when in position, is supported on the side walls of tray 22 and the tops of dividers 23. A light compartment 28 is defined by separator panel 26, upper portions of sides 14 and end walls 16, and cover 17.

It will be understood that organizer 10 can be fabricated in different sizes to accommodate different amounts of decoration for different size trees. It will also be understood that organizer 10 can be made out of various materials such as corrugated paper, plastic, and the like. Additionally, the various elements, such as the ornament hangers and ornament tray can also be fabricated of similar or different materials as desired.

Figure 5:
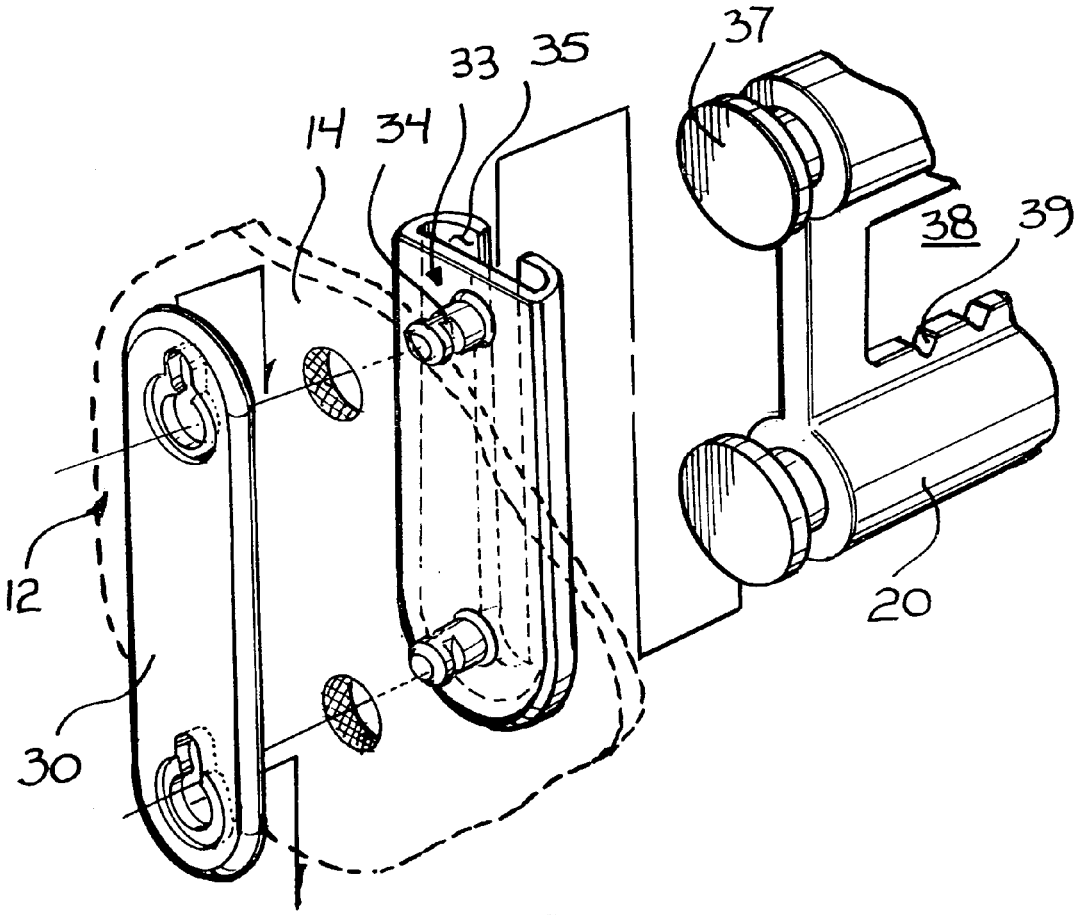
FIG. 5 is an enlarged and exploded partial perspective view of an ornament hanger and coupling.

Turning now to FIG. 5, ornament hangers 20 are removably coupled to box 12 using coupling members which can take various forms. One form is described in connection with FIG. 7, and will be described later in the description. Another form of coupling members include an anchor member 30 having keyhole apertures 32 formed therein, and a keeper clip 33 having pegs 34 extending from one side thereof and a slot 35 having an open top formed in an opposing side thereof. Keeper clips 33 are positioned on the inner surface of opposing sides 14 of box 12 with pegs 34 extending through apertures formed in opposing sides 14 of box 12. Pegs 34 are received in keyhole apertures 32 of anchor members 30 and securely held in position. Once installed, anchor portions 30 and keeper clips 33 do not need to be removed. Hangers 20 each have tabs 37 extending from ends thereof. Tabs 37 are slidably received in slots 35 through the open top thereof, and securely retained therein when properly seated. Hangers 20 are easily removed by lifting upwardly, sliding tabs 37 out of the open top of slots 35 of keeper clips 33. While only one end and one set of coupling members are illustrated in FIG. 5, it will be understood that each end of each hanger 20 will be coupled to box 12 with a set of coupling members, including anchor member 30, keeper clip 33 and tabs 37. With additional reference to FIG. 6, an example of a hanger 20 is illustrated. A central slot 38 with serrated bottom edge 39 permits ornaments to be hung thereon and securely spaced without sliding, bunching and becoming entangled.

Figure 4:
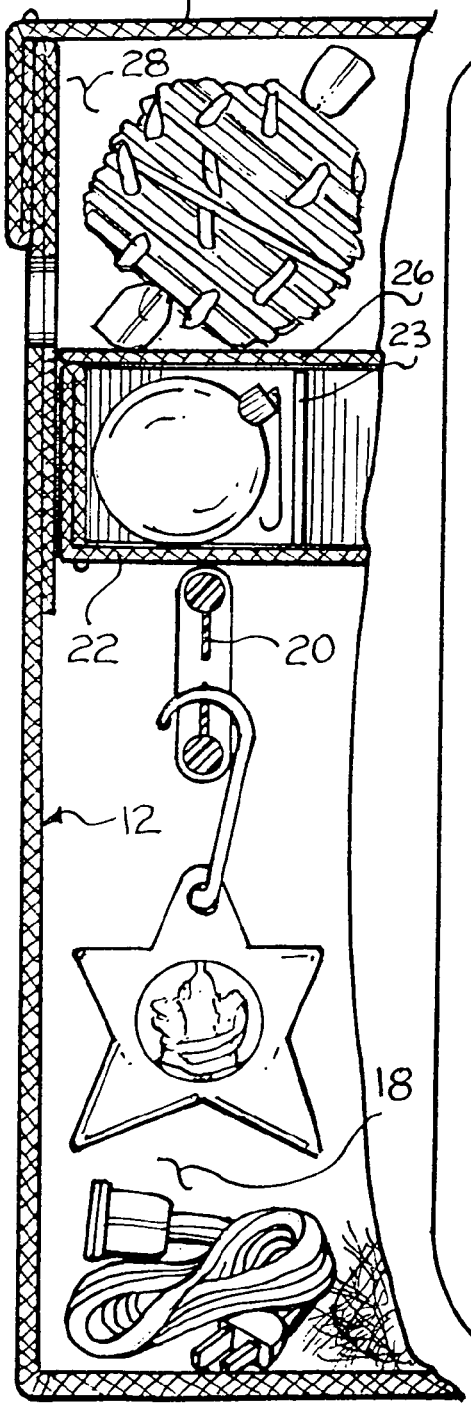
FIG. 4 is a partial section side view of the Christmas tree decoration organizer of FIG. 1.

With reference to FIG. 4, a decorator begins at the bottom of organizer 10 when storing decorations. As an example of sequential storing of tree decorations, the user removes the outer layer of decorations first. These are typically decorations such as Christmas garlands, which are placed in bulk storage space 18, at the bottom of box 12. The user then removes Christmas ornaments from the tree and hangs them on ornament hangers 20. Ornament hangers 20 are then each coupled into position on box 12, such as slid onto its corresponding keeper clip as described previously. The user then places ornament tray 22 into box 12 and it rests over the ornament hangers 20. Additional ornaments are placed into compartments 24 of ornament tray 22. Separator panel 26 is then positioned over ornament tray 22. Typically, the last decorations to be removed from a Christmas tree are the lights. Christmas lights are removed and wounded into bundles or around light holders and placed on top of separator panel 26. Cover 17 is then placed on top of and closing box 12.

As can be readily understood from the preceding description, a tree is undecorated in a logical/sequential manner, and the decorations stored in corresponding portions of organizer 10 as it is filled. A tree is decorated in the reverse manner, with the lights being removed and positioned on the tree first. Separator panel 26 is removed and the ornaments in ornament tray 22 are removed and placed on the tree. Next, ornament tray 22 is removed and ornament hangers 20 are each removed from attachment to box 12. By removing each ornament hanger 20, the ornaments hanging thereon are easily removed and hung on the tree. Finally, bulk storage space 18 is revealed. Garlands and base wraps can now be removed and added as a final touch to the tree decorations.

Turning now to FIG. 7, another embodiment of ornament hangers generally designated 40 is illustrated. In this embodiment, the coupling members include inner side braces 42 positioned within box 12 overlying the inner surface of opposing sides 14, extending past the top of bulk storage space 18, and to the bottom of the desired position of tray 22. Slots 44 are formed in the upper edge of side braces 42 to receive the ends of ornament hangers 40. In this manner the ends of hangers 40 and slots 44 cooperate to form coupling members which are easily and quickly engagable and disengagable. In this embodiment, side braces 42 and hangers are preferably fabricated of corrugated paper. One skilled in the art will understand that while corrugated paper or cardboard is used, any of the elements described can be fabricated of other materials such as plastic, wood, metal and the like.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A Christmas tree decoration organizer comprising:

a box having a bottom and upwardly extending opposing sides and end walls, terminating in a rim;

a plurality of ornament hangers having opposing ends, removably coupled within the box, the plurality of ornament hangers extending between the opposing sides in a spaced apart parallel relationship, and suspended above the bottom;

an ornament tray removably positioned within the box and supported above the plurality of ornament hangers;

a separator panel removably positioned covering the ornament tray and defining a light compartment bounded by upper portions of the opposing sides and end walls, and the rim of the box; and a cover removable engaging the rim and closing the box.

2. A Christmas tree decoration organizer as claimed in claim 1 wherein the ornament tray includes dividers separating it into a plurality of compartments.

3. A Christmas tree decoration organizer as claimed in claim 1 further including coupling members coupling the plurality of ornament hangers to the box.

4. A Christmas tree decoration organizer as claimed in claim 3 wherein the coupling members each include an anchor portion positioned at an outer surface of the opposing sides of the box, a keeper clip positioned on an inner surface of opposing sides of the box, the keeper clip attached to the anchor portion, each keeper clip removably receiving an end of one of the plurality of ornament hangers.

5. A Christmas tree decoration organizer as claimed in claim 4 wherein the keeper clip includes pegs extending therefrom, through apertures formed in the opposing sides of the box, the pegs received in keyhole apertures formed through anchor members and securely held in position.

6. A Christmas tree decoration organizer as claimed in claim 4 wherein the ends of each ornament hanger include tabs extending therefrom for receipt within a slot having an open top formed in the keeper clips.

7. A Christmas tree decoration organizer as claimed in claim 3 wherein the coupling members include inner side braces positioned within the box, each overlying an inner surface of the opposing sides and extending past the top of the bulk storage space to the bottom of a desired position of the ornament tray, an upper edge of each side brace includes slots formed therein to receive ends of the ornament hangers.

8. A Christmas tree decoration organizer comprising:

a box having a bottom and upwardly extending opposing sides and end walls, terminating in a rim;

a plurality of ornament hangers having opposing ends, removably coupled within the box, the plurality of ornament hangers extending between the opposing sides in a spaced apart parallel relationship, and suspended above the bottom for receiving and supporting a plurality of hanging ornaments;

a bulk storage space for storing outermost decorations of a Christmas tree, the bulk storage space defined by the bottom, lower portions of the opposing sides and the end walls, and the plurality of ornament hangers;

an ornament tray including dividers separating the ornament tray into a plurality of compartments, the ornament tray removably positioned within the box and supported above the plurality of ornament hangers for receiving and holding a plurality of Christmas tree ornaments;

a separator panel removably positioned covering the ornament tray and defining a light compartment bounded by upper portions of the opposing sides and end walls, and the rim of the box for holding bundles of Christmas tree lights; and a cover removable engaging the rim and closing the box.

9. A Christmas tree decoration organizer as claimed in claim 8 further including coupling members coupling the plurality of ornament hangers to the box.

10. A Christmas tree decoration organizer as claimed in claim 9 wherein the coupling members each include an anchor portion positioned at an outer surface of the opposing sides of the box, a keeper clip positioned on an inner surface of opposing sides of the box, the keeper clip attached to the anchor portion, each keeper clip removably receiving an end of one of the plurality of ornament hangers.

11. A Christmas tree decoration organizer as claimed in claim 10 wherein the keeper clip includes pegs extending therefrom, through apertures formed in the opposing sides of the box, the pegs received in keyhole apertures formed through anchor members and securely held in position.

12. A Christmas tree decoration organizer as claimed in claim 10 wherein the ends of each ornament hanger include tabs extending therefrom for receipt within a slot having an open top formed in the keeper clips.

13. A Christmas tree decoration organizer as claimed in claim 9 wherein the coupling members include inner side braces positioned within the box, each overlying an inner surface of the opposing sides and extending past the top of the bulk storage space to the bottom of a desired position of the ornament tray, an upper edge of each side brace includes slots formed therein to receive ends of the ornament hangers.

14. A method of sequentially storing Christmas tree decorations for ease in subsequent decoration of a Christmas tree, comprising the steps of:

providing a box having a bottom and upwardly extending opposing sides and end walls, terminating in a rim;

positioning coupling members at the opposing sides of the box for receiving a plurality of ornament hangers having opposing ends;

removing outer decorations from a Christmas tree and placing them in a bulk storage space defined by the bottom, lower portions of the opposing sides and the end walls;

removing hanging ornaments from a Christmas tree and hanging them on the plurality of ornament hangers;

positioning the plurality of ornament hangers between the opposing sides in a spaced apart parallel relationship supported by the coupling members and suspended above the bulk storage space;

removing additional ornaments and placing them in an ornament tray;

positioning the ornament tray within the box and supported above the plurality of ornament hangers;

placing a separator panel overlying and covering the ornament tray to define a light compartment bounded by upper portions of the opposing sides and end walls, and the rim of the box;

Placing bundles of Christmas tree lights removed from the Christmas tree onto the separator panel within the light compartment; and Placing a cover over the rim, closing the box.

15. A method as claimed in claim 14 wherein the step of positioning coupling members includes providing anchor portions positioned at an outer surface of the opposing sides of the box, providing keeper clips positioned on an inner surface of opposing sides of the box, the keeper clips attached to the anchor portions.

16. A method as claimed in claim 15 wherein the step of positioning the plurality of ornament hangers includes coupling ends thereof between keeper clips on the opposing sides.

17. A method as claimed in claim 14 wherein the step of positioning coupling members includes providing inner side braces positioned within the box, each overlying an inner surface of the opposing sides and extending past the top of the bulk storage space to the bottom of a desired position of the ornament tray, an upper edge of each side brace includes slots formed therein to receive ends of the ornament hangers.

18. A method as claimed in claim 17 wherein the step of positioning the plurality of ornament hangers includes inserting ends thereof into the slots of inner side braces on the opposing sides.

* * * * *